US006834604B2

(12) United States Patent
O'Neil et al.

(10) Patent No.: US 6,834,604 B2
(45) Date of Patent: Dec. 28, 2004

(54) TRANSPORTING A SHIP OVER SHALLOWS OF A WATERCOURSE

(75) Inventors: David A O'Neil, Essex, CT (US); William A. Wood, Vorhees, NJ (US)

(73) Assignee: Seaworthy Systems, Inc., Centerbrook, CT (US)

( * ) Notice: Subject to any disclaimer, the term of this patent is extended or adjusted under 35 U.S.C. 154(b) by 0 days.

(21) Appl. No.: 10/342,865

(22) Filed: Jan. 15, 2003

(65) Prior Publication Data

US 2003/0140837 A1 Jul. 31, 2003

Related U.S. Application Data

(60) Provisional application No. 60/350,872, filed on Jan. 22, 2002.

(51) Int. Cl.[7] ..... B63C 7/00
(52) U.S. Cl. ..... 114/44; 114/45; 405/3
(58) Field of Search ..... 114/44–48, 259, 114/260; 405/3–7

(56) References Cited

U.S. PATENT DOCUMENTS

| | | | | | |
|---|---|---|---|---|---|
| 2,390,300 | A | | 12/1945 | Harris | 114/45 |
| 2,424,164 | A | | 7/1947 | Harris | 114/46 |
| 2,932,271 | A | | 4/1960 | Crandall | 114/46 |
| 3,610,192 | A | | 10/1971 | Mauritzen | 114/45 |
| 3,610,682 | A | | 10/1971 | Leavitt | 114/45 |
| 3,721,096 | A | * | 3/1973 | Deckert et al. | 405/7 |
| 3,826,384 | A | | 7/1974 | Cecce | 214/13 |
| 4,622,912 | A | | 11/1986 | Bleke | 114/123 |
| 6,155,190 | A | * | 12/2000 | Cavanagh | 114/45 |

* cited by examiner

*Primary Examiner*—Ed Swinehart
(74) *Attorney, Agent, or Firm*—C. Nessler

(57) ABSTRACT

A laden ship is transported across a shallow portion of a watercourse by a submergible floating vessel, while the ship is lifted upwardly within the water by means of a vessel platform placed under the hull. The vessel is preferably comprised of a multiplicity of rigid U-shape, separately floodable, buoyant sections, including end sections, which have self-propulsion. The several sections are pivotably interconnected, as by hinge assemblies, so the transporter platforms adjust to major up or down bends along the length of the hull, during lifting. The platforms are surfaced with a layer of resilient deformable material, or movable blocks, to accommodate local irregularities in the bottom of the ship.

22 Claims, 6 Drawing Sheets

TRANSPORTING A SHIP OVER SHALLOWS OF A WATERCOURSE

This application claims benefit of provisional patent application Ser. No. 60/350,872, filed Jan. 22, 2002.

FIELD OF INVENTION

The present invention relates to apparatus for lifting and carrying ships over shallow areas of harbors, rivers and the like.

BACKGROUND

The presence of localized shallow regions along a watercourse has always been a problem for ships entering harbors and moving along rivers. Shallows have been addressed in various ways, including the following: When the water level varies with time, such as due to tides or flow, then a ship can await the favorable condition. A vessel may be initially designed for the draft the shallow will allow. The vessel may be off-loaded or partially loaded initially. Dredging may be used, to artificially remove the shallow region. However, all these alternatives have known disadvantages of time, transport cost, or maintenance cost.

Another technology which has been used, and which is subject of the present invention, dates from around 1688. Then, large Dutch merchant ships returning from the East Indies were inhibited by shallow river bars from entering the Zuyderzee in Holland. A system was devised to partially raise the ships out of the water and move them across the bars. Two camels, in the form of long, narrow, watertight barges, shaped to match the ship's rounded hull, or bilge, were placed on the opposing sides of the ship. They were connected to each other by sling-like cables running beneath the ship hull. The camels were partially filled with water and submerged, the cables were made taut, and then the camel ballasts were pumped out. Thus, the buoyancy of the assembly was increased and the ship was raised out of the water, to reduce its draft, sufficient to pass over the shallows. In ensuing years, development of dredging technology and canal locks supplanted the use of the camels.

In the early 1800's, increased-size whaling ships had difficulty passing over the harbor bar at Nantucket Island, off southern Massachusetts, U.S. In the mid-1840's, a modem version of the Dutch camels was used. Spaced-apart camels were rigidly connected by a wooden floor structure, upon which the ship would sit. The assembly was floated under a ship and the semi-submerged camels were raised, so the ship could be moved across the bar. There was a big improvement in convenience, over having two separate camels. Steam power, for pumping water and powering tugs, also helped a lot. Analogous problems were encountered in the mid-1800's with river and canal traffic, especially abetted by seasonal change in water levels. Abraham Lincoln, later President, obtained U.S. Pat. No. 6469, for an improvement on the Dutch technology, where the camels were inflatable.

Currently, some different kinds of devices are known in commerce for lifting vessels or for transporting them. Dry docks are rigid selectively submersible structures, used for lifting vessels from the water, typically for maintenance and repair of the hull. After a ship is floated onto a semi-submerged stationary dock, the dock is raised, to contact the hull of the vessel along the hull. Cribbing or the like is carefully pre-placed on the floor of the dock, so the ship hull is contacted and supported at numerous points along its length, to avoid any concentration of load on the hull or dock, due to bends in the keel and hull-penetration fittings and other irregularities. Typically, it takes many hours and even days, to configure a dry dock, get the ship in place, and to raise the dock and vessel from the water. Floating dry docks are sometimes made as separate segments, which are bolted or otherwise joined together to form a unitary whole of desired length. When docks are raised while holding a ship, the draining and raising of the segments is carefully controlled. Dry docks may be occasionally moved along sea lanes when they are relocated, but generally they are not adapted for moving about while containing ships. Specialized ships are used for ocean going transport of vessels and other things which either cannot move or be moved across the sea. Those special ships have a deep draft and a conventional hull shape. They are semi-submersible, for receiving a floating ship or other object on a large platform space between the bow and stern. Their design makes them unsuited for use with any shallows.

Certain patents describe art having some relation to the present invention. U.S. Pat. No. 3,736,898 to Yamura U.S. Pat. No. 3,736,898 to Yamura describes a floating dry dock made of two connected pontoon sections, with means for keeping the pontoons floating level by selectively changing the buoyancy of chambers within the pontoon sections. U.S. Pat. No. 4,510,877 to Bloxham describes a dry dock, useful also as a submergible barge, which has a deck which lacks any flotation chamber and has a cradle to support the hull of a vessel. U.S. Pat. No. 5,285,743 to Connelly describes a U-shape cross section dry dock which receives within it a submersible raft like dock portion carrying a ship or the like. U.S. Pat. No. 6,155,190 to Gronstrand describes a dry dock mounted on an aircushion vehicle for over-ground transport, where the ship being carried is supported by a keel guide in combination with a low pressure air bag structure. U.S. Pat. No. 6,152,065 to Gronstrand shows a floating boat lift where different compliant support means are used, including a net supported by springs and a vee shape cradle mounted on springs.

While the kinds of equipment mentioned serves certain purposes, getting camels in place and sized-right for the job, when ships vary greatly in dimension, is a problem. Dry docks are used for raising ships from the water, but the conventional way of using them is tedious and slow. Dredging is time consuming and entails impacts on the environment and shipping lanes, which have to be accommodated. Thus, there is a need for improvements, with respect to carrying ships over shallows when in laden condition.

SUMMARY

An object of the invention is to provide a quick and economic way of moving laden and unladen ships over shallows. A further object is to provide a means for lifting and transporting a ship while accommodating irregularities and avoiding any overstressing or changing of the lengthwise contour of the ship hull.

In accord with the invention, a ship is positioned over, and then lifted by, a platform which is buoyantly supported by ballast tanks. The platform, and thus the ship, is raised rapidly by draining the ballast tanks, sufficient to make the draft of the structure associated with the platform less than the draft which the ship previously had, and sufficient to clear the shallows to be crossed. The assembly is moved across the shallows, by either self-propulsion of the platform apparatus, or by other means, such as towing. Then the ship is released by filling the ballast tanks. Typically, the hull will be partially immersed when the assembly moves across the shallow, and the ship is kept engaged with the platform by a combination of frictional engagement with the platform and lines.

In accord with the invention, a submergible floating vessel has a bottom which comprises a platform for contacting and lifting the bottom of a ship hull. Preferably, the vessel is comprised of a multiplicity of rigid U-shape sections, at least some of which sections are connected together by means, such as hinge assemblies, which enable pivoting of one section relative to an adjacent section. Gaps, between wing walls of abutting sections of a U-shape cross section vessel, accommodate relative rotational motion of the sections. During lifting, the platform surfaces of the sections change orientation, to accommodate any up or down bend along the length of the ship hull. Preferably, the length of a U-shape section is less than the useful width between the vertical wing walls, so one section may be carried by another section.

Preferably, the platform is surfaced with a material or structure which is compliant, or adaptive, to local irregularities in the bottom of the hull, such as fittings. Thus, local overstressing is avoided due to contact of a hull protuberance with the platform surface, while macro-effect overstressing, due to up-down bending, is being avoided by the pivoting of the sections. The frictional engagement of a hull having local irregularities with the platform is desirably increased. Preferably, the platform surface has a thick layer of resilient elastomeric material. Alternately, or in combination with such a layer, the platform surface is provided with movable support blocks, which adapt to irregularities in the hull surface.

The invention provides an efficient and speedy way of moving large vessels of different lengths over shallow areas in congested or narrow waterways. By use of the invention, the usefulness of certain harbors and rivers is increased in an economic manner. Costly or environmentally problematic dredging may be avoided or deferred. As suggested by the Background, the invention will be useful primarily for harbor and river traffic and for laden ships, but may find use in other situations.

The foregoing and other objects, features and advantages of the invention will become more apparent from the following description of preferred embodiments and accompanying drawings.

DETAILED DESCRIPTION

The invention is a water vessel called here a "transporter", because of its primary intended function of transporting vessels over shallow areas of watercourses of any nature, including bays, harbors, rivers and other regions which are actually or potentially navigable. By shallow area is meant any region of a watercourse which is of lower depth than which will accommodate the draft of the ship which wishes to traverse it, including low depths regions created by shoals or bars of any nature, wrecks, and other obstructions. The transporter of the invention described here is of made of welded steel using known naval architectural principles and rules. Construction using other means, with or without steel, including use of other metals or non-metals, such as cementitious or polymer materials, is within contemplation.

Figure 1:
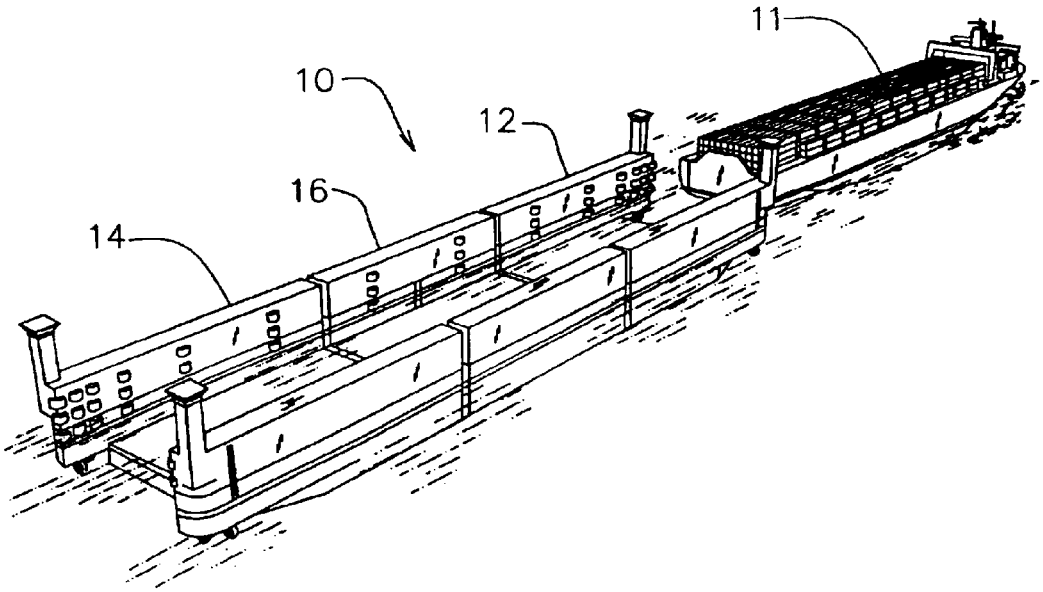
FIG. 1 is a perspective view of a 3-section transporter approaching a ship, preparatory to lifting and transporting it.
Figure 2:
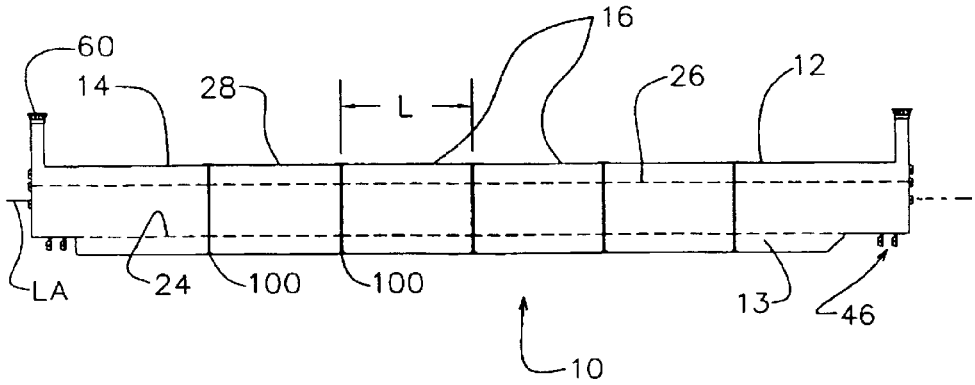
FIG. 2 is a side elevation view, or profile, transporter like that shown in FIG. 1, but having 6 sections.
Figure 3:
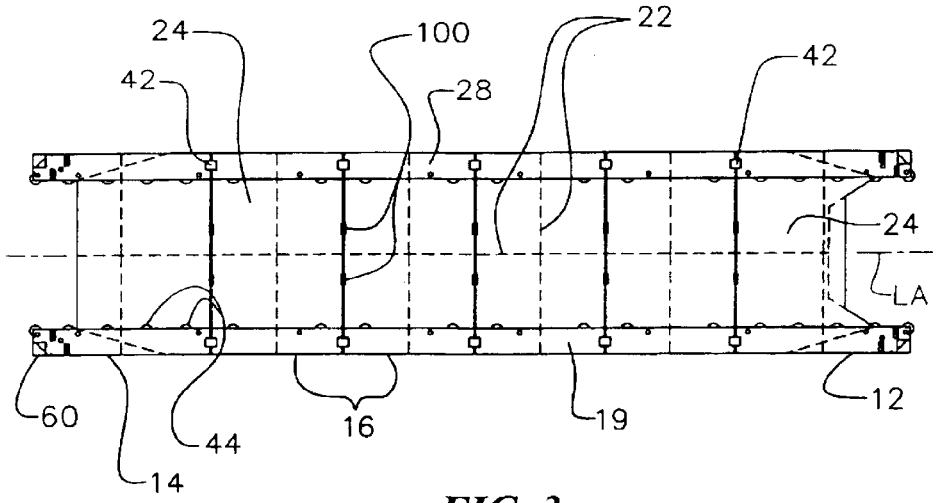
FIG. 3 is a top view of the transporter of FIG. 2.

FIG. 1 shows a transporter 10 in perspective as it floats in the water and moves toward a moored container ship 11, anticipatory to raising it and transporting it across shallows. FIG. 2 is an elevation side view, or profile, of a transporter, while FIG. 3 shows a top, or plan, view. The transporter is an assembly of independently buoyant and floodable sections. It is comprised of fore section 12 and aft section 14, both having self-propulsion, and mid-sections 16. The sections are connected together by releasable hinge assemblies 100, as described further below and lie along a longitudinal vessel axis LA. FIG. 1 shows a transporter with one mid-section. FIGS. 2 and 3 show four mid-sections and also illustrate some internal features, discussed below. The number of mid-sections which are employed may be varied, according to the size of ship to be transported and waterway constraints.

The fore and aft sections may be identical, or they may be somewhat dissimilar. For example, either or both of the fore and aft sections may have sloped or otherwise shaped underwater surfaces, to reduce drag in the water. For instance, fore section 12 has a shaped underwater bow 13. See FIG. 2. Upwardly projecting piloting towers 60, at the corners of the outer ends of the fore and aft sections, provide the operators of the transporter with visibility and a place for exercising control. Fewer than four towers may be used.

Means for propelling the fore and aft sections, and thus the interconnected transporter, are provided. Preferably, commercially available electrically powered azimuthing propeller drive units 45, with or with nozzles surrounding the propellers, are provided in duplicate (for reliability), as shown in the Figures. The propulsion units azimuth around a vertical axis, so thrust from each drive unit set can be independently directed, to propel and steer the transporter in all directions. In other embodiments, fewer and non-duplicate azimuthing propeller drives may be used; and other known propeller and rudder configurations may be used. In the generality of the invention, the transporter may have no self-propulsion, but will be propelled by means of a tethered tow boat or other vessel.

Figure 4:
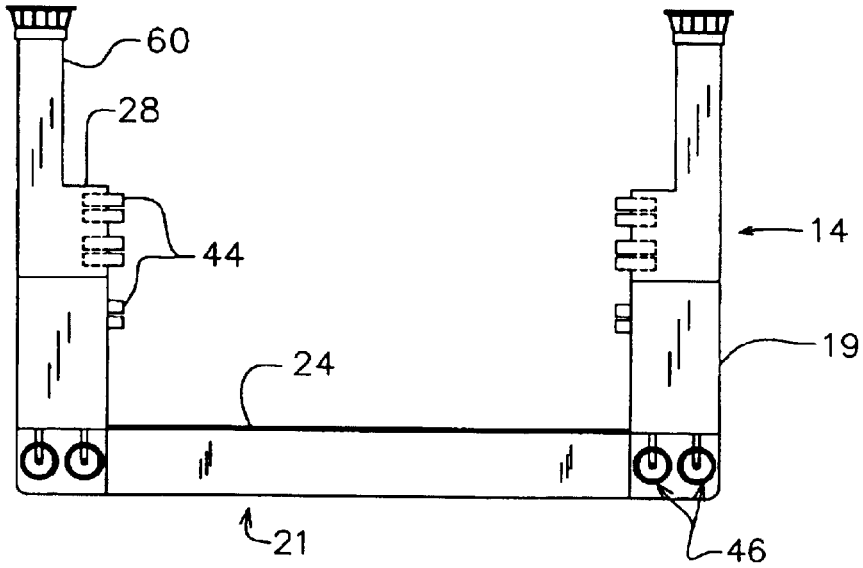
FIG. 4 is an end view of an end section of the transporter of FIG. 1.
Figure 5:
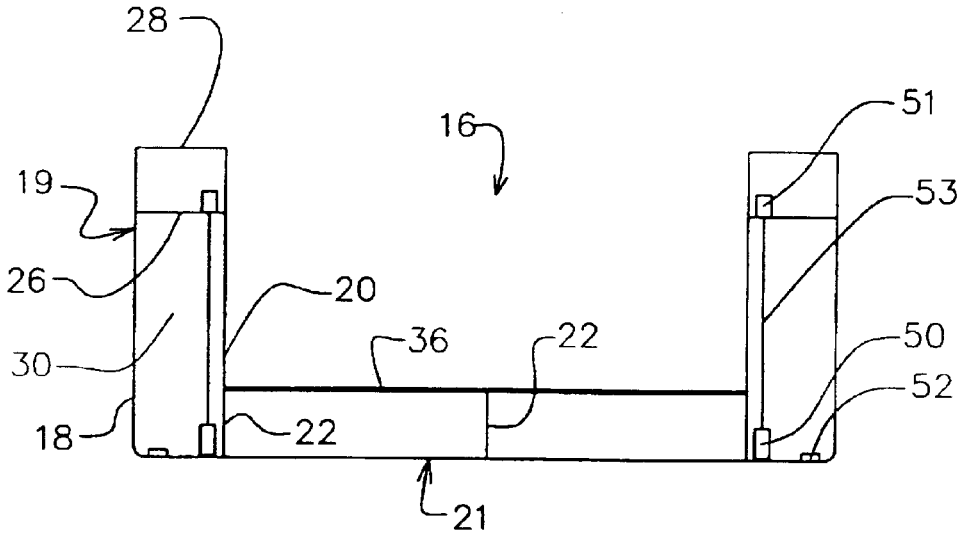
FIG. 5 is an end cross section view of one of the mid-sections of the transporter of FIG. 1.

FIGS. 4 and 5 show end elevation views of an aft section and a mid-section respectively. FIG. 5 is a cross section. The transporter sections are rigid and generally U-shape in cross section. They comprise an inner hull 18 and an outer hull 20. Each section is independently buoyant and submergible, through use of interior spaces (ballast chambers) which provide buoyancy when emptied and which can be controllably flooded by water ballast, to make the transporter sink.

Each section has opposing side wing walls 19 comprised of essentially vertical portions of the inner and outer hull 18, 20. Within the wing walls are working spaces and ballast chambers. With reference to FIGS. 1 and 4, rubber fenders 44 are provided at various points along the wing walls, to inhibit damage due to contact between the wing wall and the hull of a ship being carried. Preferably, the fenders are rubber wheels which are laterally extendable to engage the side of the ship hull. The U-shape sections have a working width W, as indicated in FIG. 4. Preferably, all the sections have the same spacing W between the opposing side wing walls, and the length L of at least one, preferably all, mid-section or end sections, is less in dimension than W. Thus, a section may be carried within one of the other sections, when it is desired to re-locate the section, to perform maintenance, or to reconfigure the transporter.

Bottom 21 is comprised of essentially horizontal portions of the inner and outer hull. It is also comprised of interior buoyancy/ballast spaces, although as described below, in another embodiment, the bottom is only a rigid structure without consequential interior spaces.

The hollow ballast spaces between the inner and outer hulls of the wing walls and the bottom are divided by longitudinal, transverse and horizontal walls 22, some of which are shown in the various Figures. The walls create separate ballast chambers 30 between the inner and outer hull, for trim, draft and stability control. The shaping, number and placement of interior ballast space walls, and the chambers thus created, will be sufficient to achieve the objectives of maintaining or changing buoyancy, trim or list in a particular configuration of transporter, in accord with the rest of the description here, and with economics and practicality. Water is flowed to and from and between the ballast chambers by suitable pumps, piping and valves, as partially illustrated by pump 50, driven by motor 51 through shaft 53, and sea valve 52, in FIG. 5. Alternative pumping and flooding devices may be used. A machinery deck 26, for electric generators, pump drives, controls, other equipment, and crew use, is located near the top of each wing wall. Access hatches and other ordinary ship features will be understood to be present. At the top of the wing walls is an open deck 28.

The sections of the transporter may be connected and disconnected while floating in the water, so the transporter length may be adapted to fit the ships being carried. Various means for fastening large floating structures, one to the other, can be employed in the generality of the invention. For example, bolts, plates or pinned timbers maybe used. Preferably, the connecting means is a pivot connection, like hinge assembly 100, which allows adaptive bending of the transporter along its length, so any commonly-encountered lengthwise up or down bend, such as sagging or hogging, of the ship hull is approximated by the platforms 24 of the transporter. Such bends along the hull girder length, as it lies in water, typically result from manufacturing variations and unevenness of cargo distribution.

Figure 9:
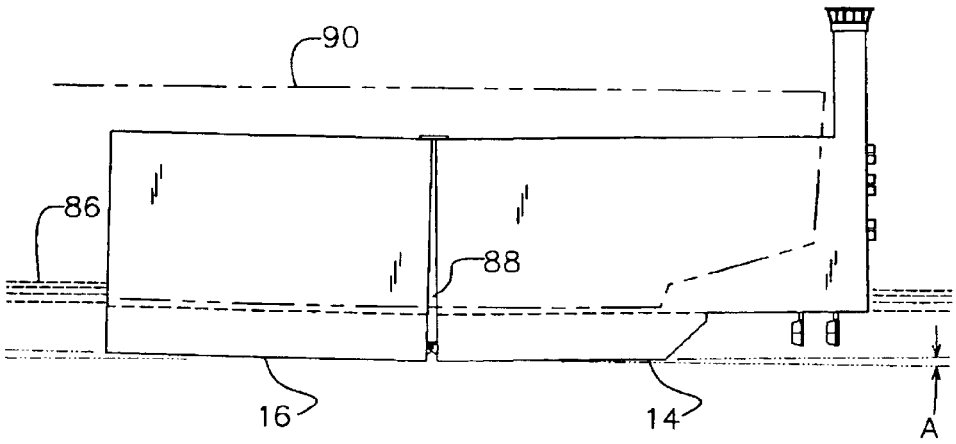
FIG. 9 is a partial side elevation view of a transporter, showing how the trim of the adjacent sections comply with a lengthwise bend in the hull of a ship being lifted.

Thus, in use with a bent hull, the longitudinal trim of a transporter section relative to the water surface, and relative to another adjacent section, is varied, due to the combination of downward force of the ship and upward buoyant force of selectively drained ballast chambers. FIG. 9 shows, with exaggeration for purposes of illustration, an end portion of a transporter carrying a ship 90, where the trims of the sections 14, 16 are at angle A to each other, to accommodate sag in the hull, and both are at small angle with the surface 86 of the water body. It follows, that when the contour of the platform string approaches fitting the contour of the hull bottom, the frictional engagement of the hull and platform, when the transporter is moving, will be enhanced.

Figure 6:
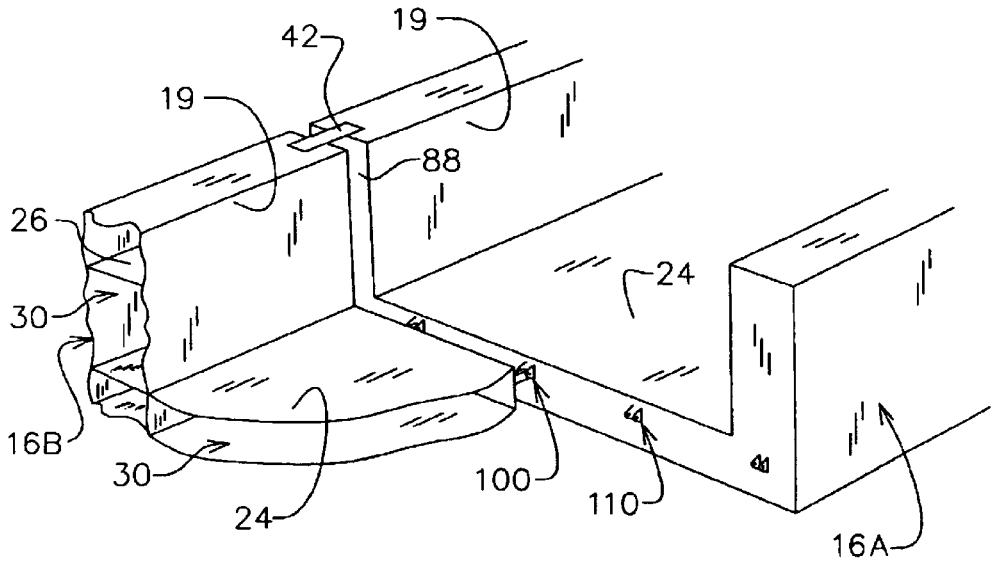
FIG. 6 is a perspective view of two transporter sections, having pin and clevis hinge assembly connections.
Figure 7:
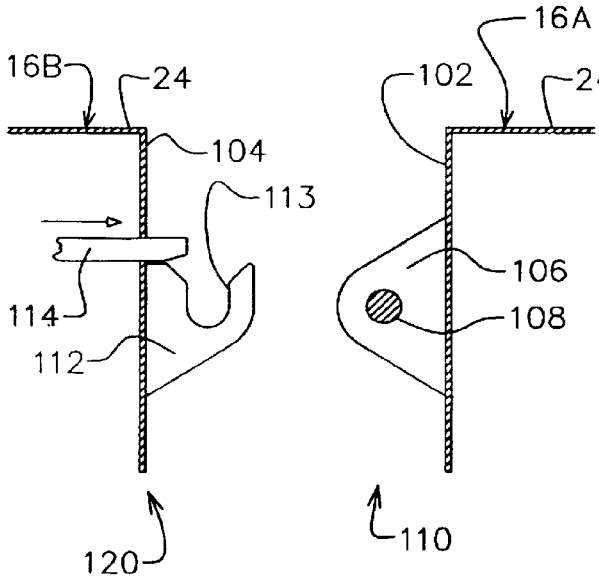
FIG. 7 is a side elevation view of a hinge assembly.
Figure 8:
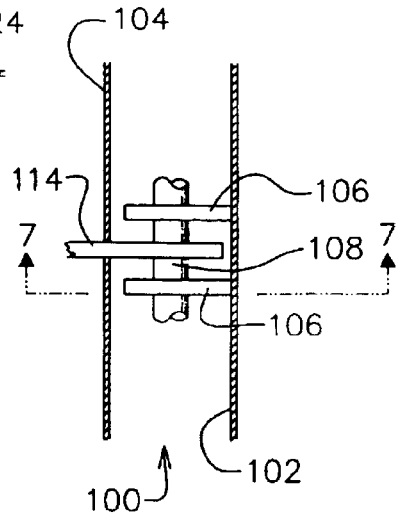
FIG. 8 is a top view of a hinge assembly.

FIG. 6 and FIG. 7, side view, and FIG. 8, top view, illustrate the preferred hinge configuration. Two mated sections 16A, 16B are connected to the other by four spaced part hinge assemblies which permit up or down rotation of the segments relative to each other. The assemblies are preferably suited for connection and disconnection, as shown. In each assembly 100, pin 108 is attached to the bottom edge of section 16A by brackets 106. Clevis subassembly 120 is comprised of stationary bracket 112, having a circular cutout 113, to receive the pin. When the cutout of the bracket 112 is engaged with the pin, as by increasing the draft of section 16B and moving the sections 16A and 16B into engagement, and then raising section 16B or lowering section 16A, slidable latch bar 114 is moved lengthwise, to capture the pin within the clevis subassembly.

Other designs for hinge means connections, which function similarly in permitting the desired up and down bending, while limiting bending in the sideways directions, will be apparent to the skilled artisan. In the claimed invention, pivot connection means includes any other means for connecting the sections together, including other pin designs, timbers or other members loosely pinned to abutting sections and overlying the joint between sections, which means enable bending of the transporter assembly in the up and down direction. The hinge pin designs are preferred because they positively connect abutting sections, and better achieve good alignment along the longitudinal axis of the transporter. In the generality of this embodiment of the invention, some sections of a string of sections may be attached without pivot connections.

As FIGS. 6 and 9 illustrate, the configuration of the sections and the hinge assemblies is such that there is a gap 88 present between the ends of wing walls of abutting sections, to allow the change in relative trim which was described. The dimension of that gap will vary with the trim of the abutting sections. Hinged bridge plates 42 are provided so that crew can move across the gap 88 from one section to another. Means may be provided for locking the sections together and temporarily preventing hinge motion. For instance, latches may be provided along the wing wall where the sections abut. Suitable connections for power, control, communication, and other needs are made by means of detachable flexible cables, lines and the like, across the gaps 88. In a rare instance, where only hogging of the ship bottom need be accommodated, the gap may be minimal. Sliding or bellows means may be provided to cover the gap while still allowing motion.

The top, or platform, 24 of the bottom part of a U-section, supports the load of the ship being carried. Typically, there are irregularities and a certain degree of unevenness along the length of a ship hull. For instance, there are irregularities due to fittings and manufacturing variations.

Usually, when a ship is lifted in a dry dock with the known art, keel and bilge blocks, cribbing and the like are preplaced on the platform of the dry dock, to contact the hull at predetermined locations. The objective is to avoid local over-stressing of the hull due to concentrated loads because of variation in how a hull and platform of a dry dock mate. Since a purpose of the transporter here is to move ships relatively quickly across shallow areas, the time and tedious labor, to accurately position the prior art types of support structure, must be avoided. How large scale bending in the hull is accommodated was just described. In a further feature of the invention, the platform 24 is fitted with a compliant material or structure, which adapts to irregularities in the ship hull surface.

Figure 10:
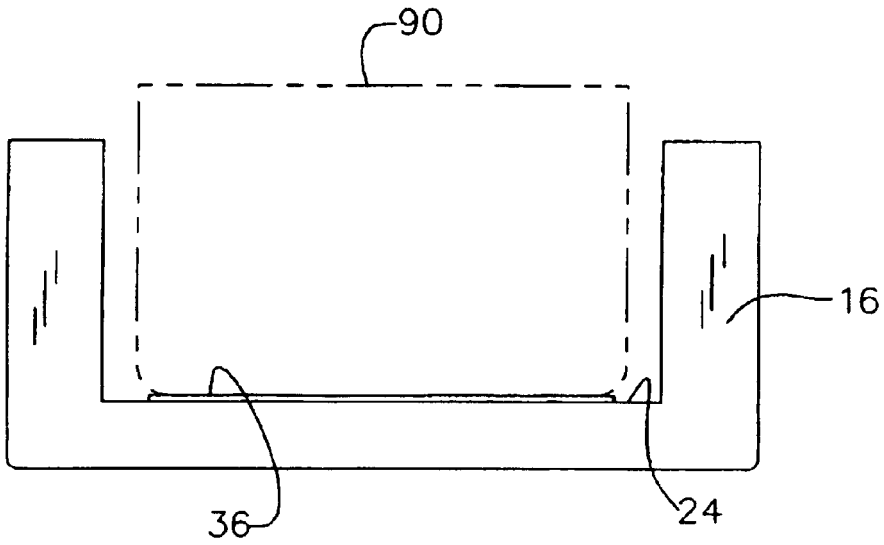
FIG. 10 is an end view of a transporter section showing a compliant layer on the platform.

FIG. 10 shows an end view of a transporter section 16 containing a ship hull 90, in phantom. The ship rests on a thick layer of resilient material, such as rubber, which resiliently deforms in an extent sufficient to allow accommodation of local hull protuberances and variations. The layer is exaggerated in dimension in the Figure for purposes of illustration. The layer is comprised of an artificial or modified natural rubber, for example a combination of recycled synthetic or natural elastomers with a binder. The layer may be from 10 to 60 cm thick and may vary in thickness. It may be continuous or discontinuous and cover the whole or only central part of the platform. The layer is held in place by adhesives, fasteners or other known means. Other compliant surface layer materials may be used, which are not resilient, including polymers which are permanently deformed, and including granular material held in place by suitable fences or netting.

Figure 11:
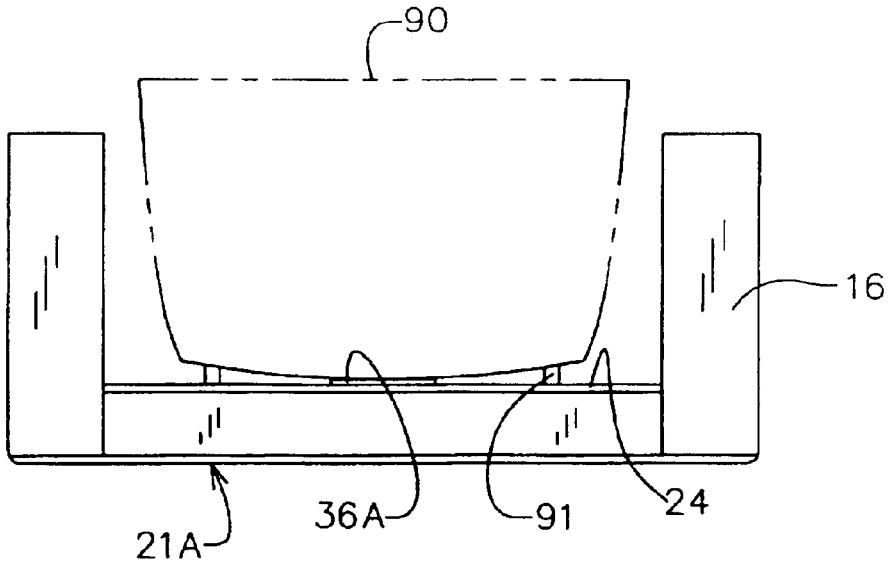
FIG. 11 is an end view like FIG. 10, shown a combination of central deformable layer and spaced apart blocks, which may be movable in the vertical direction.

FIG. 11 indicates another alternative, in which the ship hull rests on a centerline layer of resiliently deformable material, in combination with a multiplicity of blocks 91, spaced apart on either side of the transporter section centerline. Blocks 91 may in part or whole be made of deformable material, and preferably are movable. In one embodiment, blocks 91 are mounted on heavy compression springs. In another, blocks 91 comprise pads mounted on the ends of upwardly projecting hydraulic or air cylinders, the motion of which can be controlled by an appropriate supply system. Pressure sensors may be used with a control system, so a desired force distribution is provided along the hull surface, to achieve the aforementioned aims. Embodiments of compliant or adaptive platform structure which include movable blocks are less preferred from the standpoint of initial cost, maintenance cost, and complexity. When the platform has a surface which is movably compliant with irregularities on the ship bottom, the frictional engagement of the hull with the platform will be desirably increased.

It follows that when any irregularity in the hull contacts a deformable material at a certain point, or a movable block, then the local point of contact between the hull and the surface will move downwardly, as the hull irregularity presses into the material or pushes against the movable block. The localized compliance or adaptive motion of the platform surface causes a redistribution of the lifting load on the hull, sufficient to avoid adverse effects on the hull. From the foregoing, it will be understood that the pivotally connected sections and the compliant platform surface work together to avoid overstressing or local deformation of the hull, and to frictionally engage the hull with the platform.

The bottom of the transporter is preferably comprised of sufficient ballast chambers to provide that portion with self-flotation. Alternately, the bottom is a rigid beam structure with little or no space for receiving ballast water, and insufficient for self-flotation.

While the U-shape configuration is preferred, in the generality of the invention, wing walls may be largely or in part omitted. For instance, a transporter may have only one wing wall or other protuberance which projects above the water at all times. For example, it may have a stilt-tower projecting upward from one of two opposing side pontoons. In the generality of the invention, the platform which lifts the ship is lifted by floodable floating means and is submergible. In addition to ballast chambers that can be selectively flooded and drained, a transporter section may be configured to have some chambers, or separately attached pontoon sections, which are never flooded.

The transporter is used as follows to move a floating ship across a shallow portion of a waterway. The transporter draft is increased by flooding, by opening sea valves and allowing ballast water to flow into the ballast chambers. The ballast chambers are flooded to the extent necessary, to submerge the platform so it is lower than the bottom of the hull of the ship to be moved. The transporter is propelled toward the moored or anchored, and essentially stationary, ship, so that the ship becomes essentially encompassed within the wing walls. Lines are run to secure the ship within the confines of the transporter, longitudinally and transversely. The ship will be generally centered in the transporter by the combination of lines and extendable fenders 44.

Then, water ballast is discharged by pumping, to lift the transporter and to cause the platform to contact the hull of the ship at a multiplicity of points along its length, and to thereby lift the ship. The adaptive material on the platform surface assumes a compliant shape, and the platform sections pivot, distributing the load of the ship and avoiding any overstress of the hull structure, as would occur if the lifting force tended toward substantially changing the lengthwise straightness or curvature, as the case may be, of the hull. There is frictional engagement of the ship with the platform, with or without the use of compliant material on the surface. That friction helps directly keep the ship in place on the platform during subsequent movement of the transporter along the waterway, and combines with the indirect means of the securing, namely the lines running to the wing walls. Preferably, the pumps and valves are sized so that the draft of the transporter changes at a rate of at least about 7 meters (about 23 feet) per hour; and, more preferably more than 10 m/hr, with the aim of lifting a typical large ship in about an hour.

The trims of the abutting transporter sections change as the surfaces of the platforms generally adapt to the local line of the gross lengthwise contour of the ship hull, to an extent allowed by the transporter operator's control of the amount of ballast/buoyancy at any section or part of section.

Typically, the combination of transporter and ship will be buoyed up only the amount required, so that the draft of the combination is less than the original draft of the ship, and less than the depth of water in the shallow region to be crossed; and, in doing such, the hull of the ship will remain partially immersed. When such is the case, the transporter does not have to bear the entire load of the ship and the time for the undertaking is lessened. And, sea or river water usage by the ship, for operation of machinery or equipment, can be continued during the transport.

The combination of transporter and ship are then moved across the shallow region, using the self-propulsion means, or other means when self-propulsion is not used. During such, water of the waterway flows along the length of the transporter, across the platform and between the hull of the ship and the wing walls. For convenience, the transporter may carry the ship to close proximity to a dock or mooring; or, it may simply go as far as to cross the shallow region. Then, the ballast chambers of the transporter are flooded, sufficient to lower the draft of the transporter and to allow the ship to float freely in the water. When resilient material is on the surface of the platform it commences to resume its original shape. The ship is unsecured from the platform; and, the platform moves away from vicinity of the ship.

Although this invention has been shown and described with respect to a preferred embodiment, it will be understood by those skilled in this art that various changes in form and detail thereof may be made without departing from the spirit and scope of the claimed invention.

We claim:

1. A submergible floating water vessel, for transporting a ship, comprising a multiplicity of interconnected sections lying along a longitudinal vessel axis, each section having (a) opposing side floodable floating means;

(b) a bottom running between the opposing side floating means, the bottom comprising a platform for lifting and supporting the hull of a ship being transported; and, (c) means for flowing water into and out of said floating means to change the draft of the section; and, pivot connection means, for interconnecting two adjacent sections, to enable relative rotational motion of said least two adjacent sections in the vertical longitudinal plane of the vessel.

2. The vessel of claim 1, wherein the platform further comprises compliant means on the surface thereof, for distributing the lifting force applied to the hull by the platform.

3. The vessel of claim 2, wherein the compliant means comprises a resilient elastomeric material.

4. The vessel of claim 1, wherein the pivot connection means comprises a multiplicity of pin and clevis assemblies spaced apart along the abutting bottoms of at least two mated interconnected sections, wherein the pivot connections are disconnectable and reconnectable, when the vessel is floating in the water.

5. The vessel of claim 1, wherein said multiplicity of sections comprises: first and second self-propelled end sections, having underwater shaping which reduces drag; and, at least one mid-section having no self-propulsion.

6. The vessel of claim 1 wherein the sections have rigid U-shape cross-sections comprising wing walls; wherein the wing walls comprise the vertical portions of the U-shape cross section and said bottom comprises a horizontal portion of the U-shape; and, wherein said spaced apart floodable floating means are ballast chambers within the wing walls.

7. The vessel of claim 6, wherein said pivot connection means comprises disconnectable hinges located at the ends of the abutting bottoms of at least two mated sections; further comprising a gap between the wing walls of said two adjacent sections, to enable relative rotational motion of the adjacent sections about said hinges.

8. The vessel of claim 1 wherein each section further comprises a bottom having at least one floodable chamber along with means for flowing water into and out of said chamber.

9. The vessel of claim 6 wherein the spacing between the wing walls of the sections is substantially similar; wherein at least one of said sections has a length less than said spacing between the wing walls, so said at least one section may be carried within another section.

10. A submergible floating water vessel, for transporting a ship, comprised of a multiplicity of interconnected sections lying along a longitudinal vessel axis, wherein each section is comprised of:

(a) a rigid U-shape cross section comprising opposing side wing walls having ballast chambers;

(b) a bottom running between the wing walls, the bottom having a platform for lifting and supporting the hull of a ship being transported; and, (c) means for flowing water into and out of the ballast chambers, to change the draft of the sections;

wherein, some of said platforms have a surface which is compliant to irregularities in the bottom of the hull of a ship being supported thereon; said multiplicity further comprising, pivot connection means, for interconnecting mated sections, to enable relative rotational motion of mated sections in the up and down direction, when the platforms thereof come into contact with the hull of a ship being lifted for transport by the vessel.

11. A submergible water vessel, for transporting a ship, comprising:

a multiplicity of interconnected platforms, wherein each platform is part of a bottom running between opposing side floodable means: to thereby provide a platform surface for lifting the hull of a ship, wherein the platform surface is movably compliant (a) to bending along the length of the hull of the ship, by vertical plane pivoting of the platforms at the points of interconnection, and (b) to surface irregularities of the bottom of the hull of the ship by local change in elevation of the platform surface;

means for flowing water into and out of said floating means, to change the draft of the vessel, so that the draft of the vessel with a ship resting on the platform becomes less than the draft of the ship when freely floating;

means for preventing longitudinal and transverse motion of the ship to relative to the platform, and, means for propelling the vessel along a shallow portion of waterway, while a ship is resting on the platform.

12. The vessel of claim 11 wherein said platform surface comprises a resiliently deformable material running lengthwise along the center portion of the platform surface, for compliance to said surface irregularities.

13. The vessel of claim 11 wherein said platform surface comprises movable blocks projecting upwardly, for contacting and supporting the hull of a ship being transported on the platform.

14. The vessel of claim 11 which further comprises floodable floating means within said bottom.

15. The vessel of claim 11 further comprising opposing side wing walls, wherein the spaced apart floodable floating means comprise ballast chambers located within said wing walls.

16. The vessel of claim 11 wherein the means for flowing water in and out of said floating means provides a rate of change of draft of the vessel which is in excess of about 7 meters per hour.

17. The vessel of claim 11 wherein said means for propelling comprises self-propulsion units at opposing ends of the vessel.

18. The method of transporting a floating ship across a shallow portion of a waterway, wherein the ship hull bottom has irregularities and an up or down bend along the hull length, which comprises:

positioning a ship within the length of a vessel comprised of a multiplicity of interconnected U-shape cross section buoyant sections; wherein, each section has at least one ballast chamber floodable by water; each section has a platform for contacting and lifting a portion of the hull of the ship; and each platform has a surface which adapts to the shape of irregularities of the hull bottom, to distribute concentrations of lifting force from the platform;

raising the said buoyant sections by flowing water from said ballast chambers, to move the platforms upwardly, so they contact and lift the hull;

wherein, when the platform lifts the hull, some points of contact between the hull and the surface of the platform move downwardly, so the platform surface adapts to said irregularities; and wherein, the relative orientations of at least two adjacent sections rotate in the up and down direction, to bring the platform surfaces thereof toward conformance with the bend in the hull; and, then moving the vessel with the ship contained within the U-section, from a first location to a second location, while said platform surface contact conditions and said orientations of the platforms are maintained.

19. The method of transporting a floating ship across a shallow portion of a waterway, wherein the ship has a hull bottom having an up or down lengthwise bend, which comprises:

placing a multiplicity of rigid, buoyantly supported interconnected platforms beneath the hull of a floating ship having a first draft, said multiplicity of platforms providing a lifting surface which is adaptive to irregularities in the hull;

moving the platform upwardly, to thereby apply upward forces to the hull at a multiplicity of lengthwise platform contact points, to lift the hull and decrease the draft thereof while leaving the hull partially immersed in the water, sufficient to make the draft of the platforms and any associated structure less than said first draft;

altering the trim and buoyancy of the platforms, when moving the platforms upwardly, to avoid substantial change in the bend of the ship hull bottom, compared to change in bending which occurs when moving the ship upwardly with a one piece platform.

then, moving said platforms along the waterway while said ship hull is in said lifted position wherein the ship is secured to the platforms; and, then, lowering said platforms downwardly by changing the bouyancy of the buoyant support of the platforms, sufficient to enable the ship to float freely in the water; unsecuring the ship from the platforms; and, then moving the platforms away from vicinity of the ship.

20. The method of claim 19 wherein, the longitudinal trim of the ship is substantially maintained while it is being lifted and moved by the vessel.

21. The method of claim 19, further comprising moving the vessel by means of propulsion means mounted on sections which comprise the ends of the vessel.

22. The method of claim 19 further comprising:

anchoring or mooring the ship to the bed of the water body in which the ship floats, prior to moving said multiplicity of platforms beneath the hull; and, raising the anchor or releasing the mooring, after the draft of the ship is decreased by the upward motion of the platform, and before moving said platforms with the ship thereon.

* * * * *